US005532709A

United States Patent [19]

Talty

[11] Patent Number: 5,532,709

[45] Date of Patent: Jul. 2, 1996

[54] DIRECTIONAL ANTENNA FOR VEHICLE ENTRY SYSTEM

[75] Inventor: Timothy J. Talty, Trenton, Mich.

[73] Assignee: Ford Motor Company, Dearborn, Mich.

[21] Appl. No.: 333,191

[22] Filed: Nov. 2, 1994

[51] Int. Cl.[6] ..... H01Q 19/30

[52] U.S. Cl. ..... 343/819; 343/713; 343/817

[58] Field of Search ..... 343/713, 817, 343/818, 819, 810, 812

[56] References Cited

U.S. PATENT DOCUMENTS

| | | | |
|---|---|---|---|
| 2,490,777 | 12/1949 | Bryant et al. . | |
| 2,841,787 | 7/1958 | Knott . | |
| 4,097,868 | 6/1978 | Borowick | 343/817 X |
| 4,184,400 | 1/1980 | Cermignani et al. | 343/817 X |
| 4,514,734 | 4/1985 | Cermignani et al. . | |
| 4,536,752 | 8/1985 | Cheal et al. . | |
| 4,719,460 | 1/1988 | Takeuchi et al. | 340/825.31 |
| 4,727,377 | 2/1988 | Yotsuya et al. . | |
| 4,763,121 | 8/1988 | Tomoda et al. | 340/825.54 |
| 4,812,855 | 3/1989 | Coe et al. . | |
| 4,978,963 | 12/1990 | Thorpe . | |
| 5,008,681 | 4/1991 | Cavallaro et al. | 343/819 X |
| 5,061,944 | 10/1991 | Powers et al. . | |
| 5,337,066 | 8/1994 | Hirata et al. . | |

OTHER PUBLICATIONS

Encyclopedia of Electronics and Computers, Sybil P. Parker, 1984, pp. 930–931.

*Primary Examiner*—Donald T. Hajec
*Assistant Examiner*—Tho G. Phan
*Attorney, Agent, or Firm*—Mark Mollon

[57] ABSTRACT

The invention uses a modified Yagi-Uda antenna as a directional antenna for remote entry applications for transportation vehicles. To reduce the area that the antenna requires for packaging in a vehicle headliner, the antenna employs a shared reflector for plural reception zones on opposite sides of the vehicle. Since the antenna is packaged close to body sheet metal, a folded dipole is used as the antenna feed element to increase input impedance and simplify impedance matching with the receiver.

3 Claims, 2 Drawing Sheets

DIRECTIONAL ANTENNA FOR VEHICLE ENTRY SYSTEM

BACKGROUND OF THE INVENTION

The present invention relates in general to remote vehicle entry systems, and more specifically to a directional antenna to establish certain reception zones for a remote vehicle entry system.

Remote entry systems are known for cars, trucks, and other transportation vehicles which operate locks anti-theft systems and vehicle personality features such as seat and mirror position. A remote entry radio receiver is mounted in the vehicle which responds to a radio transmitter carried by the user of the vehicle. In one common type of system, the user depresses a control button on the remote transmitter causing a coded signal to be transmitted to the receiver identifying a command desired by the user, e.g. lock or unlock doors, unlock trunk, or arm, disarm or trigger an anti-theft system. Unique portions of the codes identify the individual transmitter to insure that only an authorized user gains access to the vehicle. The codes may also differentiate between a plurality of authorized transmitters, each carried by a different driver of the vehicle, to allow automatic adjustment of vehicle accessories according to the preset personalities of the particular user (e.g., seat and mirror positions and radio settings).

In another type of system known as a passive entry system, communication between the transmitter and receiver occurs automatically when the portable transmitter comes within a predetermined distance of the receiver. Preferably, the receiver detects not only the presence of an authorized transmitter but also localizes the transmitter to a predetermined zone around the perimeter of the vehicle in order to only unlock an appropriate door or trunk adjacent to that zone. Such localization may also be desired is pushbutton remote entry systems.

Radio frequency (RF) communication signals are typically employed for their advantages of penetrating and passing through other objects, their low power, and their low cost. In order to differentiate between predetermined zones around the perimeter of the vehicle, a directional antenna is required to localize the RF signals from the portable transmitter. The antenna signals may also have to be processed to determine which antenna receives a stronger signal, thus localizing the transmitter.

Prior art directional antennas suffer from disadvantages of having complex shapes and large size making them difficult to package in a vehicle. It is preferable to conceal the antenna to protect it from the environment and to improve vehicle aesthetics. In order to conceal the antenna, it is usually necessary to locate the antenna beneath the sheet metal body of a vehicle. However, the sheet metal shields and adversely affects the performance of the antenna.

SUMMARY OF THE INVENTION

The present invention has the advantage of providing a concealed, directional antenna for remote entry systems that is easily packaged in a vehicle and provides good antenna performance.

More specifically, the invention provides a directional antenna for concealed mounting on a transportation vehicle to receive radio-frequency (RF) signals from a predetermined zone outside the transportation vehicle. An elongated active antenna element has dipole feed points at opposite ends thereof. An elongated director element is disposed between the elongated active antenna element and the zone and resonantly directs the RF signals to the elongated active antenna element. An elongated reflector element is disposed at a side of the elongated active antenna element opposite of the zone and resonantly reflects the RF signals to the elongated active antenna element.

The antenna structure of this invention is similar to that of the Yagi-Uda antenna used at very high frequency ranges, such as television broadcast reception. Such a Yagi-Uda antenna is modified by providing a folded dipole for the active element to provide acceptable input impedance when used in the vicinity of a sheet metal body panel. Furthermore, two antennas may utilize a shared reflector element to provide separate predetermined zones on opposite sides of the vehicle while reducing the overall antenna size.

DETAILED DESCRIPTION OF PREFERRED EMBODIMENTS

Figure 1:
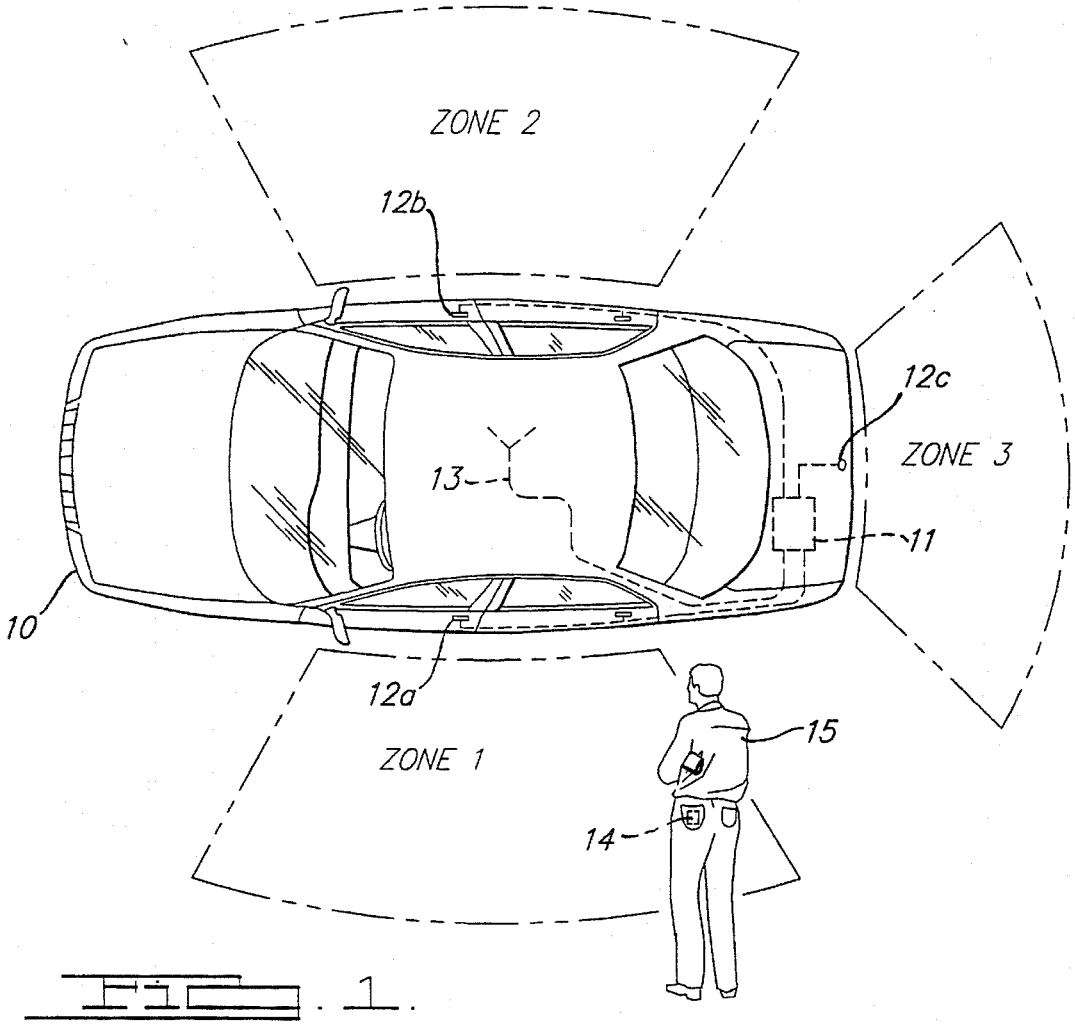
FIG. 1 is an overhead diagrammatic view showing the components and operation of a remote entry system.

Referring to FIG. 1, a vehicle 10 includes a remote entry receiver 11 mounted in a suitable location, such as in a trunk of a car. Receiver 11 is coupled to a plurality of lock actuators including a driver door lock 12*a*, a passenger door lock 12*b*, and a trunk lock 12*c*. Receiver 11 is also coupled to one or more antennas 13 for receiving coded signals transmitted by a portable transmitter 14 carried by a user 15. Portable transmitter 14 may be comprised of a transponder device getting its energy from transmissions by receiver 11 or may be a self-powered transmitter. Preferably, antennas 13 distinguish between a plurality of zones including Zone 1 adjacent the driver door, Zone 2 adjacent the passenger door, and Zone 3 adjacent the trunk.

Antennas 13 preferably include a separate antenna aimed at each respective zone. Alternatively, the invention may utilize direction-finding schemes known in the art that employ antennas oriented to provide slightly overlapping reception areas. In either case, the zone is identified according to the antenna most strongly receiving the transmitted signal. Receiver 11 accordingly unlocks a corresponding door to allow the user access at the point where he approaches the vehicle.

The present invention utilizes a modified Yagi-Uda antenna to provide a directional antenna for receiving a coded signal from a predetermined zone. An active dipole element has an associated director element and reflector element to focus RF signals from a predetermined direction onto the active element and to substantially exclude RF signals from other directions (e.g., from behind it).

Figure 2:
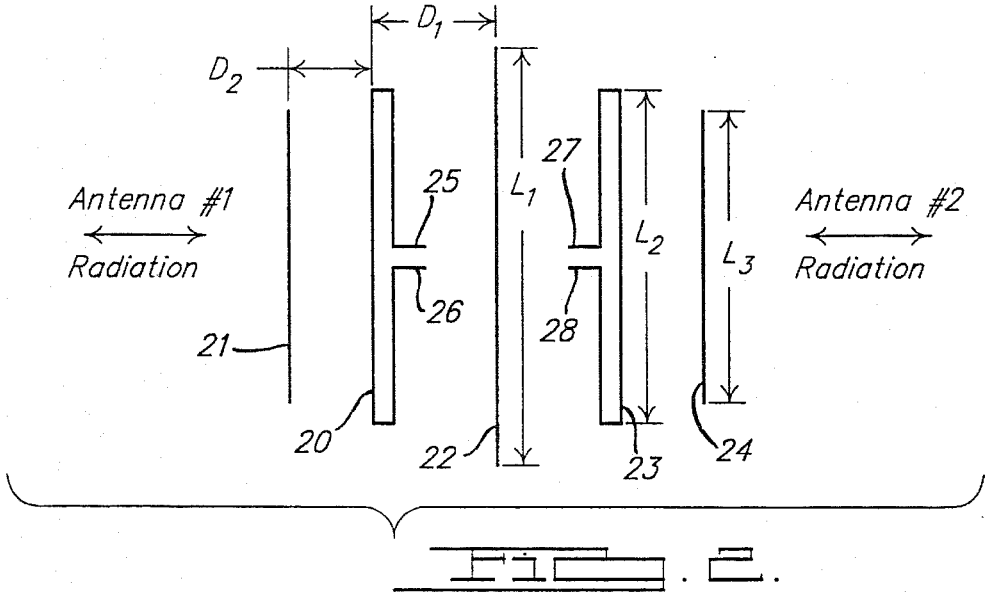
FIG. 2 is a plan view showing a preferred layout for a directional antenna according to the present invention.

FIG. 2 shows an integrated pair of antennas according to a preferred embodiment of the present invention to establish zones on opposite sides of a vehicle (e.g., Zones 1 and 2 in FIG. 1). The antennas are formed of conductive lines formed on a supportive substrate (not shown). A first antenna includes an active element 20, a director element 21, and a reflector element 22. A second antenna includes an active element 23, a director element 24, and shares reflector element 22 with the first antenna. Reflector element 22 has a length $L_1$. Active elements 20 and 23 each include a longest side having a length $L_2$. Director elements 21 and 24 each have a length $L_3$. The active elements 20 and 23 have their side of longest dimension parallel with and separated from reflector 22 by a distance $D_1$. The active elements are separated from their respective director elements by a distance $D_2$. The lengths and distances are determined as known to those skilled in the art in accordance with the reception frequency desired. For example, a remote entry system having an operating frequency of 315 MHz was tested utilizing dimensions of $L_1$=0.4295 meters, $L_2$=0.4314 meters, $L_3$=0.4 meters, $D_1$=0.357 meters and $D_2$=0.2381 meters.

Active element 20 is sensitive to RF signals as shown by the "antenna #1 radiation" direction, and active antenna element 23 is sensitive in the "antenna #2 radiation" direction. Any crossover signals passing reflector 22 are greatly attenuated such that each antenna is substantially unaffected by signals in the opposite zone.

Preferably, the antennas of the present invention are packaged in a vehicle headliner close to the sheet metal of the vehicle roof. The antenna may also be packaged beneath a trunk lid or a hood of a vehicle which are also usually formed of sheet metal. As a result of the proximity to sheet metal, the input impedance of the antenna is decreased. In order to compensate for low input impedance, each active antenna element 20 and 23 is formed into a folded dipole with increased input impedance but still maintaining the resonant relationship between the directors and reflector according to a standard Yagi-Uda antenna. Thus, the folding still maintains the characteristic length $L_2$ of the active element for resonant interaction with the director and reflector while relocating the feed points increases the antenna impedance. The resulting increased input impedance facilitates impedance matching with the receiver.

Feed points 25 and 26 provide the output of folded dipole 20 and feed points 27 and 28 provide the output of folded dipole 23. The specific location of feed points for the folded dipoles depend upon operating frequency, the interaction of sheet metal structures, and other factors that are apparent to those skilled in the art. Location of the feed points can be determined using known techniques, such as impedance matching, VSWR measurements, and mismatch loss calculations.

Figure 3:
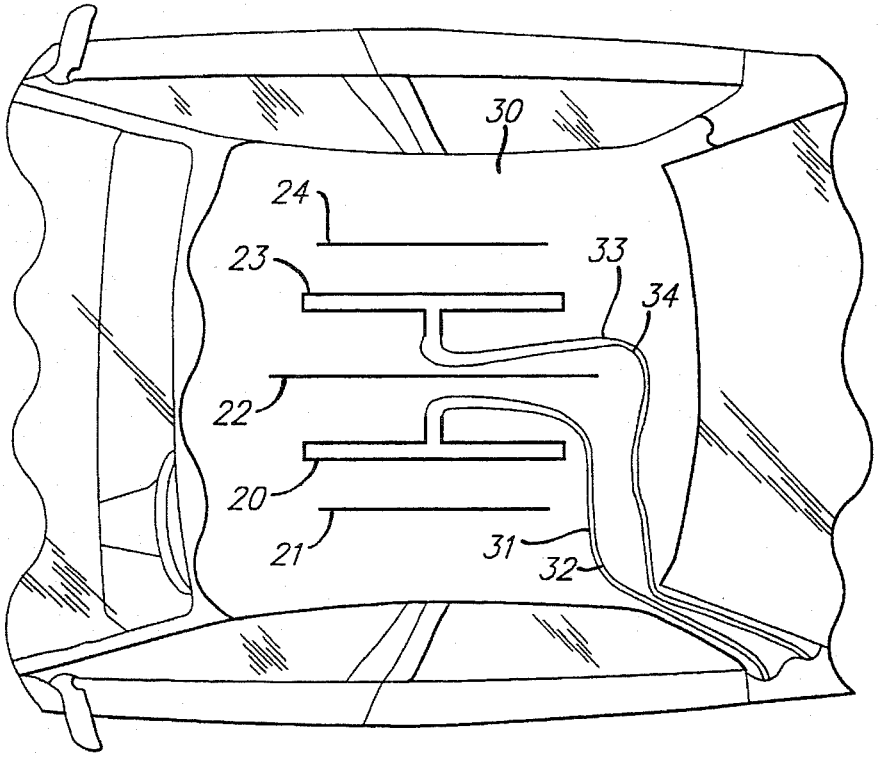
FIG. 3 is a top view showing the antenna of the present invention installed on the top surface of a vehicle headliner.

FIG. 3 shows antenna elements forming a pair of antennas mounted directly on a headliner 30 of a vehicle. The headliner is a trim piece installed on the underside of a sheet metal roof panel. The antenna elements preferably are comprised of an electrical wire or conductor glued or taped to the upperside of headliner 30. Active antenna element 20 receives signals from the driver side of the vehicle which are coupled to the remote entry receiver over antenna leads 31 and 32. RF signals received by active antenna element 23 from the passenger side of the vehicle are coupled to the receiver over antenna leads 33 and 34.

Figure 4:
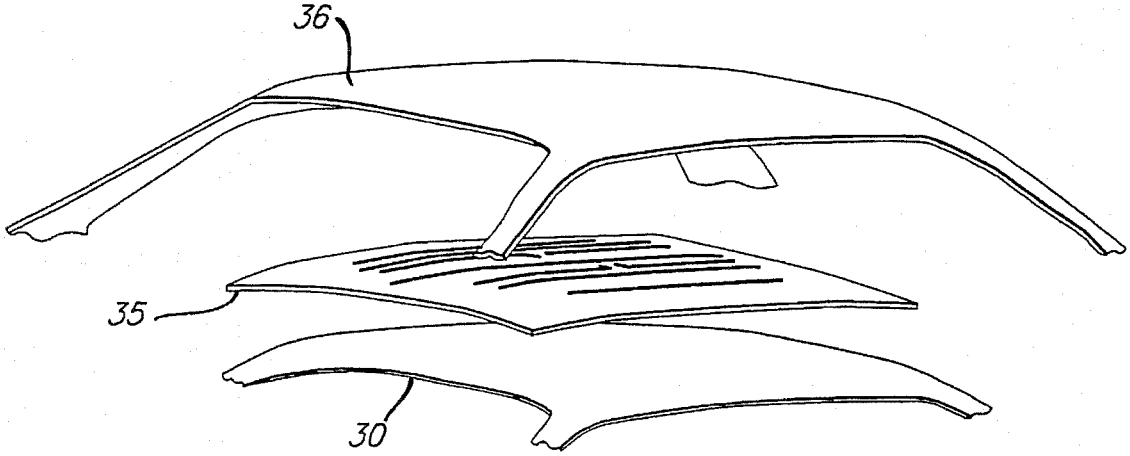
FIG. 4 is a side exploded view showing an alternate embodiment for packaging of an antenna within the roof of a vehicle.

FIG. 4 shows an alternate embodiment where the antenna is supported by a separate substrate 35 formed, for example, of cardboard. Substrate 35 is then sandwiched between headliner 30 and roof panel 36 during manufacture of the vehicle.

What is claimed is:

1. A pair of directional antennas for concealed mounting on a transportation vehicle to receive radio-frequency (RF) signals from first and second predetermined zones on opposite sides of said transportation vehicle, comprising:

a shared reflector element substantially bisecting said first and second predetermined zones;

a first elongated active antenna element positioned between said shared reflector and said first predetermined zone;

a first elongated director element disposed between said first elongated active antenna element and said first predetermined zone and resonantly directing said RF signals from said first predetermined zone to said first elongated active antenna element;

a second elongated active antenna element positioned between said shared reflector and said second predetermined zone; and a second elongated director element disposed between said second elongated active antenna element and said second predetermined zone and resonantly directing said RF signals from said second predetermined zone to said second elongated active antenna element.

2. The antennas of claim 1 wherein said first and second elongated active antenna elements are each comprised of a folded dipole.

3. The antennas of claim 1 wherein both antennas are packaged beneath a sheet metal panel of said transportation vehicle.

a directional antenna mounted on said transportation vehicle including an elongated active.

* * * * *